US005397649A

United States Patent [19]

Schienle et al.

[11] Patent Number: 5,397,649

[45] Date of Patent: Mar. 14, 1995

[54] INTERMEDIATE COATING LAYER FOR HIGH TEMPERATURE RUBBING SEALS FOR ROTARY REGENERATORS

[75] Inventors: James L. Schienle; Thomas E. Strangman, both of Phoenix, Ariz.

[73] Assignee: AlliedSignal Inc., Morris Township, Morris County, N.J.

[21] Appl. No.: 935,628

[22] Filed: Aug. 26, 1992

[51] Int. Cl.[6] ..... B22F 7/04

[52] U.S. Cl. ..... 428/552; 428/553; 428/557; 428/558; 428/564

[58] Field of Search ..... 29/195; 75/171; 117/17 M; 204/425; 310/11; 415/174; 418/552; 420/558; 427/34, 35, 42; 428/547, 552, 633, 651, 678, 698, 552

[56] References Cited

U.S. PATENT DOCUMENTS

| | | | |
|---|---|---|---|
| 3,481,715 | 12/1969 | Whalen | 29/195 |
| 3,719,519 | 3/1973 | Perugini | 117/17 M |
| 3,754,903 | 8/1973 | Goward et al. | 75/171 |
| 4,005,989 | 2/1977 | Preston | 428/651 |
| 4,055,705 | 10/1977 | Stecura et al. | 428/633 |
| 4,093,879 | 6/1978 | Marchant et al. | 310/11 |
| 4,145,481 | 3/1979 | Gupta et al. | 428/678 |
| 4,399,199 | 8/1983 | McGill et al. | 428/633 |
| 4,485,151 | 11/1984 | Stecura | 428/633 |
| 4,615,865 | 10/1986 | Duvall et al. | 420/558 |
| 4,639,399 | 1/1987 | Aprigliano | 428/623 |
| 4,675,204 | 6/1987 | Nicoll et al. | 427/35 |
| 4,676,994 | 6/1987 | Demaray | 427/42 |
| 4,752,535 | 6/1988 | Kvernes | 428/547 |
| 4,764,089 | 8/1988 | Strangman | 415/174 |
| 4,801,510 | 1/1989 | Mehrotra et al. | 428/698 |
| 4,861,618 | 8/1989 | Vine et al. | 427/34 |
| 4,897,315 | 1/1990 | Gupta | 428/552 |
| 4,914,794 | 4/1990 | Strangman | 29/889.2 |
| 4,915,814 | 4/1990 | Harada et al. | 204/425 |
| 4,943,487 | 7/1990 | Benn et al. | 418/552 |
| 4,950,558 | 8/1990 | Sarin | 428/698 |

OTHER PUBLICATIONS

ATTAP/AGT101 Advanced Turbine Technology Applications Project, By: Allied-Signal Aerospace, Oct. 1990.

*Primary Examiner*—Donald P. Walsh
*Assistant Examiner*—John Greaves
*Attorney, Agent, or Firm*—Jerry J. Holden; Robert A. Walsh

[57] ABSTRACT

A metallic regenerator seal is provided having multi-layer coating comprising a NiCrAlY bond layer, a yttria stabilized zirconia (YSZ) intermediate layer, and a ceramic high temperature solid lubricant surface layer comprising zinc oxide, calcium fluoride, and tin oxide. Because of the YSZ intermediate layer, the coating is thermodynamically stable and resists swelling at high temperatures.

7 Claims, 2 Drawing Sheets

INTERMEDIATE COATING LAYER FOR HIGH TEMPERATURE RUBBING SEALS FOR ROTARY REGENERATORS

GOVERNMENT RIGHTS

The Government of the United States of America has rights in this invention pursuant to Contract No. DEN3-335 awarded by the U.S. Department of Energy.

TECHNICAL FIELD

This invention relates to protective coatings for metal substrates, and in particular to a regenerator seal multilayer coating having a ceramic surface layer, a yttria stabilized zirconia intermediate layer, and a metallic bonding layer.

BACKGROUND OF THE INVENTION

Because rotary regenerators for gas turbine engines are now being made of a ceramic material, they require seals formed from material that can provide sufficient coating wear life. To achieve this life, this material must be oxidation resistant at temperatures up to and exceeding about 1600° F., and have a low coefficient of friction to minimize torque loads on the regenerator. U.S. Pat. No. 3,481,715 discloses a regenerator seal comprised of a surface layer of nickel oxide, calcium fluoride, and calcium oxide on a steel substrate. An intermediate layer comprising an alloy of nickel with aluminum or chromium may be added to improve the adhesion of the surface layer to the substrate.

A problem with the prior art regenerator seal is the reactive nature of its constituents, especially at temperatures greater than 1600° F. Both nickel oxide and calcium fluoride tend to react with underlying metallic elements. For example, the chrome, aluminum, and iron in the substrate or intermediate layer tends to strip oxygen from the nickel oxide, while the calcium fluoride tends to react with aluminum to form aluminum fluoride gas phases. These reactions accelerate the oxidation of the metallic bond coating and metallic substrate, causing deterioration of the bonding interface, and swelling of the regenerator seal. This swelling may result in binding of the rotating regenerator core, which produces high torque loads and can result in core failure. Core binding may also produce high frictional shear loads at the coating-regenerator interface, which can lead to accelerated wear of the regenerator seal and core. The swelling, which occurs predominantly in the metallic bonding coating layer, can also produce high interfacial shear stresses at coating interfaces, and can lead to premature coating failure, particularly when accompanied by high frictional shear loads resulting from core binding.

One proposed solution to this problem has been to use a surface layer of zinc oxide, calcium fluoride, and tin oxide, with an intermediate coating of nickel oxide and calcium fluoride. However, even with these coatings the above-described problems at interfaces between metal alloys and nickel oxide and calcium fluoride are still encountered, particularly above 1600° F. Additionally, zinc oxide and tin oxide have chemical compatibility problems of their own. In particular, zinc oxide and tin oxide will be stripped of their oxygen by metallic elements such as chrome, iron, and aluminum. Additionally, if elemental nickel is present, perhaps from reduction of nickel oxide in the underlying intermediate layer, tin and nickel may react to form $Ni_3Sn$.

Accordingly, there is a need for a coating for a regenerator seal that has a low coefficient of friction, good oxidation resistance, and has stable composition and bonding up to and exceeding temperatures of 1600° F.

SUMMARY OF THE INVENTION

An object of the present invention is to provide a seal, for ceramic rotating regenerators, that has a low coefficient of friction, good oxidation resistance, a stable composition, and stable bonding up to and well exceeding temperatures of 1600° F.

The present invention achieves the above-stated object by providing a regenerator seal having a metallic substrate, a metallic bond coating composed of NiCrAlY plasma sprayed over the substrate, a yttria stabilized zirconia intermediate layer plasma sprayed onto the metallic bond coating, and a ceramic high temperature solid lubricant surface layer plasma sprayed on top of the intermediate layer and comprising zinc oxide, calcium fluoride, and tin oxide.

These and other objects, features and advantages of the present invention are specifically set forth in or will become apparent from the following detailed description of a preferred embodiment of the invention.

DESCRIPTION OF THE INVENTION

Figure 1:
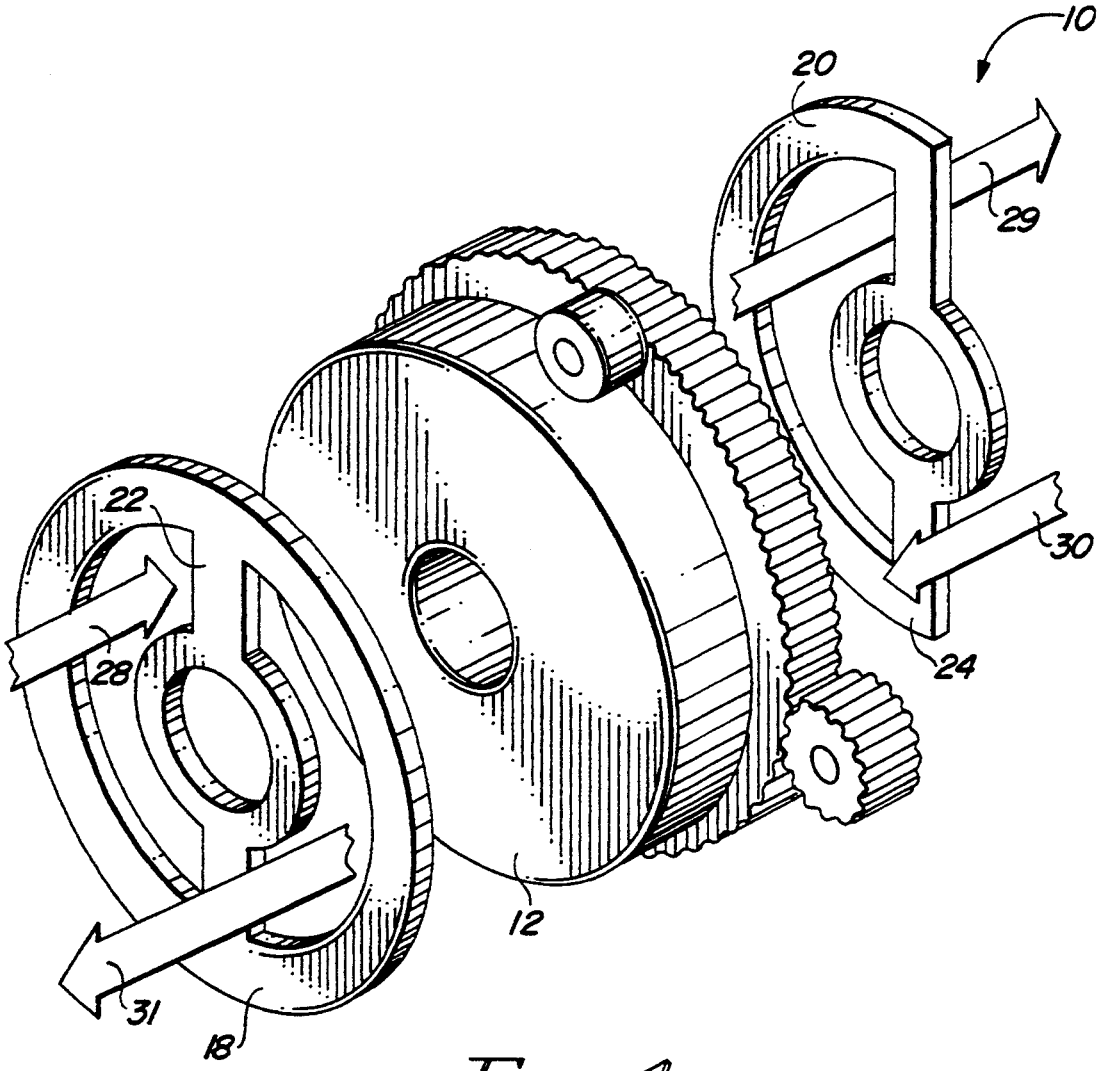
FIG. 1 shows a typical rotating regenerator system including the regenerator core and regenerator rubbing seals.

Referring to FIG. 1, a regenerator, or rotating counter flow heat exchanger, to which the present invention relates is generally denoted by the reference numeral 10. The regenerator 10 comprises a rotating regenerator core 12, typically fabricated from low expansion glass-ceramic material, such as aluminum silicate or magnesium aluminosilicate, and a pair of regenerator seals 18,20 which are also referred to as rubbing seals. The seals 18,20 are located on the hot and cold sides respectfully, of the core 12.

When mounted in a gas turbine engine, the regenerator seal crossarms 22,24 split the engine's flow path in two. The first flow path, represented by arrow 28 delivers low pressure, hot gas from the turbine discharge to the hot side regenerator core 12 and the second flow path, represented by arrow 30, delivers high pressure, cool gas from the compressor discharge to the cold side of the core 12. Within the rotating core 12 the thermal energy from the hot gas is tranferred to the cool gas so that low pressure, low temperature gas is discharged from the core 12, represented by arrow 29 and high pressure, hot gas is discharged from the core 12 represented by arrow 31. The regenerator seals 18,20 separate the low pressure gases from the high pressure gases.

While the following description will only reference the seal 18, it is none the less applicable to the seal 20. The seal 18 is formed from a superalloy such as Haynes 230, Incoloy MA956, or HS-25. Superalloys are generally those alloys characterized as nickel, iron or cobalt based alloys which display high strengths at high temperatures. In the preferred embodiment, the substrate surface 32 of the seal 18 is fabricated to have a series of longitudinal grooves having a nominal depth of about 0.030 inches measuring from peak to valley. Also, the nominal distance between groove centers is 0.050 inches. These grooves enhance adhesion of any coating layers applied thereon. Depending on the particular seal material, the grooves may be manufactured by a variety of techniques including machining, electrodischarge machining, electrochemical machining, and laser machining.

Figure 2:
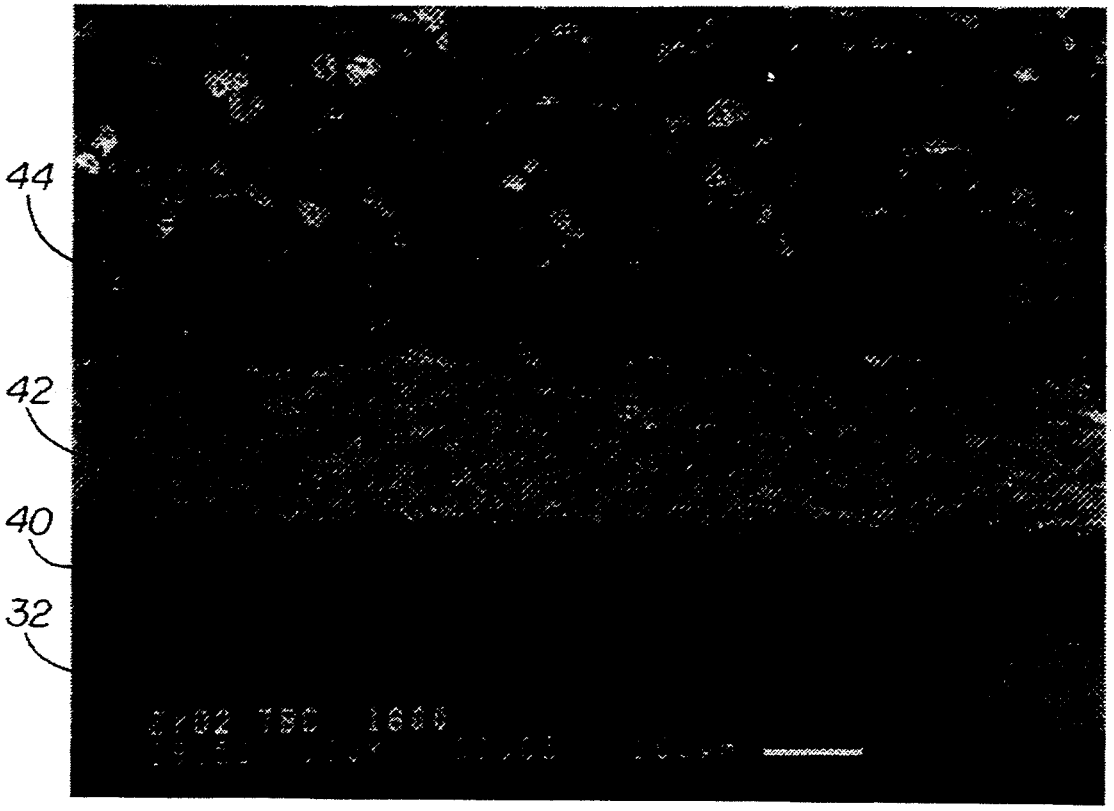
FIG. 2 is a photomicrograph of a test coupon having a coating in accordance with the present invention.

Referring to FIG. 2, after a conventional grit cleaning operation, a thin bonding layer 40 of oxidation resistant material, such as NiCrAlY having the composition 23 weight percent chrome, 6 weight percent aluminum, 0.5 weight percent yttrium, and the balance being nickel, is applied onto the grooved surface 32 by low pressure or vacuum or inert gas (argon) shrouded air plasma spraying to a preferred thickness of about 0.004 inches. The NiCrAlY layer 40 provides a high degree of adherence between the nickel based metallic surface 32 and and a ceramic intermediate coating layer 42 described below.

The intermediate layer 42 of yttria stabilized zirconia (hereinafter referred to as YSZ) is applied to the surface of the NiCrAlY layer 40 by an air plasma spray gun to a thickness of about 0.010 inches. The YSZ layer has a composition similar to conventional thermal barrier coatings and nominally contains 8 weight percent yttria to inhibit formation of large volume fraction of monoclinic phase. Additionally, the process for applying the YSZ layer is the same as used for thermal barrier coating applications and can be performed by companies such as APS, located in Dayton, Ohio.

Again referring to FIG. 2, a solid lubricant surface coating layer 44 having the composition 56 weight percent zinc oxide, 29 weight percent calcium fluoride, and 15 weight percent tin oxide is applied to the YSZ layer 42 by an air plasma spray gun. The layer 44 has a preferred thickness of about 0.040 to 0,050 inches and can be applied by the same companies that apply the layer 42. The as-sprayed surface layer 44 has surface asperities which must be machined off to provide a smooth surface with sufficient tribological and sealing characteristics. Preferably, the as-sprayed surface asperities of the surface layer 44 are removed by machining so that the layer 44 has a final thickness of about 0,035 to 0.045 inches.

Two different tests were run to compare the thermal stability and oxidation resistance of the above described regenerator seal coating having the YSZ intermediate layer 42, to a conventional regenerator seal coating having a nickel oxide—calcium fluoride intermediate layer (hereinafter referred to as the baseline).

The first test included a 10 hour static air heat treatments of coated coupons at temperatures between 1600° F. and 2000° F. at 100° F. intervals. After exposure, polished cross-sections of the coated coupons were prepared for metallographic analysis of coating interfaces. Also, element mapping using wavelength dispersive x-ray analysis was performed to identify any elemental diffusion resulting from the oxidation heat treatment. Throughout the test and even when exposed to temperature on the order of 2000° F., coupons having the YSZ coating 42 did not exhibit any evidence of oxidation or diffusion into adjacent layers. In contrast, coupons with the baseline coating exhibited evidence of oxidation with the bond coating and inward diffusion of calcium and fluorine into the bond coating at temperatures as low as 0° F. At 1900° F., the baseline coating spalled rendering it useless as protective coating. Thus, the coating having the YSZ intermediate or barrier layer demonstrated superior compositional stability.

The second test included a 100 hour static air heat treatment of coated coupons at 1800° F., which is the current maximum regenerator inlet temperature for Allied-Signal's AGT101 automotive gas turbine engine test bed. Thickness measurements of the coated coupons were taken after 1, 10, and 100 hours of exposure. As shown in table 1, the YSZ coated coupons exhibited virtually no swelling during the 100 hour heat treatment while the baseline coated coupons seal exhibited significant swelling.

TABLE 1

THICKNESS MEASUREMENTS FOR REGENERATOR SEAL COATINGS HEAT TREATED AT 1800 F. IN STATIC AIR FURNACE

| Intermediate coating | Area | Starting Thickness Inch | 1 Hour Thickness, Inch | 1 Hour Change, Mil | 10 Hours Thickness, Inch | 10 Hours Change, Mil | 100 Hours Thickness, Inch | 100 Hours Change Mil |
|---|---|---|---|---|---|---|---|---|
| | 1 | 0.210 | 0.212 | 2.0 | 0.216 | 6.0 | 0.232 | 22.0 |
| | 2 | 0.218 | 0.219 | 1.0 | 0.224 | 6.0 | 0.231 | 13.0 |
| Baseline | 3 | 0.211 | 0.213 | 2.0 | 0.216 | 5.0 | 0.232 | 21.0 |
| | 4 | 0.218 | 0.219 | 1.0 | 0.224 | 6.0 | 0.231 | 13.0 |
| | 5 | 0.218 | 0.220 | 2.5 | 0.222 | 4.5 | 0.239 | 21.5 |
| | Avg. | — | — | 1.7 | — | 5.5 | — | 18.1 |
| | 1 | 0.218 | 0.217 | −1.0 | 0.218 | 0.0 | 0.219 | 1.0 |
| | 2 | 0.218 | 0.218 | 0.0 | 0.218 | 0.0 | 0.219 | 1.0 |
| YSZ | 3 | 0.215 | 0.216 | 1.0 | 0.216 | 1.0 | 0.217 | 2.0 |
| | 4 | 0.216 | 0.214 | −2.0 | 0.217 | 1.0 | 0.217 | 1.0 |
| | 5 | 0.217 | 0.217 | 0.0 | 0.217 | 0.0 | 0.217 | 0.0 |
| | Avg. | — | — | −0.4 | — | 0.4 | — | 1.0 |

1 mil = 0.001 inch

Thus the YSZ coated coupons demonstrated superior resistance to seal swelling.

These tests demonstrate that a coating having the YSZ intermediate layer 42 has excellent oxidation resistance, and excellent dimensional stability, particularly in respect to seal swelling. While the invention has been described with reference to a particular embodiment thereof, those skilled in the art will be able to make various modification to the described process without departing from the true spirit and scope of the invention. For example, different combinations of substrate and bond coating may be used. An iron-based superalloy, such a Incoloy MA956, with a FeCrAlY bond coating, or a cobalt-based superalloy, such as HS-25, with a CoCrAlY bond coating. Further, additional elements and oxides such as Si, Hf, La, Ya, Nb, alumina, and yttria can be added to any of the,MCrAlY bond coatings to enhance the coating's environmental resistance and compatibility with the substrate. Essentially, any bond coating composition sufficient to adhere a YSZ thermal barrier coating to a substrate can be used to adhere the YSZ intermediate layer. Likewise, surface coating compositions other than that described above may be used, as long as the composition includes at least one of the following compounds as all or part of its composition: calcium fluoride, zinc oxide, tin oxide, and nickel oxide. Additionally, there are numerous ceramic materials other than yttria which can be used to stabilize zirconia, such as ceria. Additionally, there are other high expansion oxides besides YSZ which provide good expansion matches with the metallic substrate and have equivalent chemical compatibility, such as yttria stabilized hafnia. Alumina is another thermodynamically stable barrier layer that can substitute for the YSZ layer 42 in less severe applications where a larger thermal expansion mismatch with the superalloy substrate can be tolerated.

What is claimed is:

1. A sealing member having a low coefficient of friction and good resistance to oxidation at high temperatures when rubbing against a ceramic material comprising:

a superalloy substrate;

a bonding layer of MCrAlY, where M is selected from the group consisting of Ni, Co, NiCo, and Fe;

a ceramic layer of stabilized zirconia, or stabilized hafnia; and a ceramic solid lubricant layer, said lubricant layer having some calcium fluoride.

2. The sealing member of claim 1 wherein the thickness of said bonding layer is about 0.004 inches.

3. The sealing member of claim 1 wherein said substrate surface has a plurality of grooves for enhancing the adhesion of any coating layer applied thereto.

4. The sealing member of claim 1 wherein said stabilized ceramic layer is yttria stabilized.

5. The sealing member of claim 4 wherein the thickness of said stabilized ceramic layer is about 0.010 inches.

6. The'sealing member of claim 1 wherein said stabilized ceramic layer is ceria stabilized.

7. The sealing member of claim 1 wherein the thickness of said ceramic solid lubricant layer is about 0.035 inches to 0.045 inches.

* * * * *